United States Patent [19]

Spence et al.

[11] Patent Number: 4,477,165

[45] Date of Patent: Oct. 16, 1984

[54] DIFFUSION TRANSFER PROCESSOR

[75] Inventors: Clifton L. Spence, Woodbridge, Va.; Walter Lissiuk, Silver Spring, Md.

[73] Assignee: LogEtronics, Inc., Springfield, Va.

[21] Appl. No.: 524,052

[22] Filed: Aug. 17, 1983

[51] Int. Cl.[3] ..... G03D 9/00

[52] U.S. Cl. ..... 354/299; 354/302; 354/328; 354/339

[58] Field of Search ..... 354/299, 301, 302, 305, 354/316, 320, 321, 322, 328, 338, 339

[56] References Cited

U.S. PATENT DOCUMENTS

| | | | |
|---|---|---|---|
| 3,078,777 | 2/1963 | Carlson | 354/301 |
| 3,257,927 | 6/1966 | De Belder | 354/302 |
| 3,283,689 | 11/1966 | Carlson | 354/301 |
| 3,455,229 | 7/1969 | Frohock | 354/302 |
| 3,505,944 | 4/1970 | Holley | 354/301 |
| 4,034,389 | 7/1977 | Huss | 354/316 |
| 4,362,376 | 12/1982 | Otani | 354/339 |

OTHER PUBLICATIONS

"EKTAFLEX Processing Information".

"Installing, Using Your Kodak EKTAFLEX PCT Processor, Mode 12," Eastman Kodak Co.

"Color Proofing with Kodak EKTAFLEX PCT Products for Color Prep", Brochure, Eastman Kodak Co., 11/82.

*Primary Examiner*—A. A. Mathews

*Attorney, Agent, or Firm*—Pollock, Vande Sande & Priddy

[57] ABSTRACT

Apparatus for reproducing photographic images by diffusion transfer. A first path is provided for receiving an image-carrying photographic sheet of the diffusion transfer type, for developing. A lower guide in the first path includes a plurality of irregularly spaced protrusions which cooperate with vertically extending flexible blades. The material to be developed passes between the flexible blades and the lower arcuate guide member during processing. While the first path is processing the image-carrying sheet, a sheet of print material is being advanced simultaneously through a second path, the first and second paths having a common exit aperture. Disposed at the common exit aperture is a means for laminating the print medium and developed image-carrying sheet. The laminated structure exits onto a receiving tray for temporary storage during the diffusion phase, prior to delamination of the sheets to reveal the transferred positive image.

9 Claims, 15 Drawing Figures

HEATER
55
12a
12
13
13a
13b
13c
13A
15
34
40
40a
41
42
45
11
11a
11b
19
20
25
54

DIFFUSION TRANSFER PROCESSOR

The present invention relates to automatic processors for developing prints through use of the diffusion transfer technique. Specifically, a diffusion transfer (D.T.) processor is described, suitable for making a positive color print from an exposed reversal positive color film.

Printing photographic images from color negative films through the use of the diffusion transfer process is well known. Processors are available for use in a darkroom environment to make, in a relatively brief period of time, positive photographic prints from color film. One such device, the Kodak EKTAFLEX TM processor, employs a combination wet and dry technique and receives an exposed negative film and a suitable sheet of image-receiving print paper, develops the negative rapidly in a bath of activator fluid, and then laminates the developed film to the print paper. A few minutes thereafter, the laminated film and print paper are separated by the operator, to reveal the finished print.

In some color printing applications it is desirable to work directly with a reversal positive film. Such material is considerably more complex than the reversal negative film, however, and consequently, far more sensitive to pressure and temperature discontinuities. Local temperature variations in the developing solution can form hot spots which will produce local density differences during development of the reversal positive film, whereas with a reversal negative film, little effect is noticeable in the resulting print.

The effects of non-uniform pressure on the developing image are also more severe in processing reversal positive film. A typical diffusion transfer processor may apply local agitation to the developing film surface through rollers or other surface contact means, and the applied pressure may cause streaking of the transfer image which will ultimately be reproduced in the final print.

The sensitivity of these materials to temperature differences is also seen in the final step of the diffusion transfer process, when the laminated receiving sheet and developed film emulsion are placed in combination on a receiving tray to allow completion of the D.T. phase prior to delaminating the sheets. Local markings resulting from variations in the surface temperature between the laminated sheets and the receiving tray may appear as streaks across the print.

SUMMARY OF THE INVENTION

It is a primary object of this invention to provide a diffusion transfer processor capable of producing high quality reversal positive color prints.

This and other objects are achieved by the processor of the present invention which provides for developing and printing either reversal negative or positive color film. The processor provides separate wet and dry paths for simultaneously-fed exposed film and unimaged printing medium. The wet path includes a guide with raised protrusions which is submerged in the developer activator solution. A plurality of flexible vanes, vertically positioned over the guide, are sequentially displaced upon passage of the exposed film over the protrusions, providing local agitation and mixing of the activator fluid. The dry path, through which the printing medium is conveyed, has an exit trajectory coincident with the exit trajectory of the wet path.

In a preferred embodiment of the invention, lamination of the image-carrying film with the printing medium is accomplished with a pair of rollers positioned at the combined exit trajectories of the two transport paths. The laminating rollers are preferably maintained in a uniformly moistened condition by contact with a roller supported for rotation in a moistening chamber which also contains the activator fluid.

In yet another aspect of the preferred embodiment, a pair of feed rollers is positioned at the input of the two transport paths for directing either the paper medium or the photographic film to its respective path. The axis of one of the pair of feed rollers is rotatable about the axis of the remaining feed roller to change the feed angle of the roller pair and, thereby, the transport path to be used.

DESCRIPTION OF PREFERRED EMBODIMENT

Figures 1A, 1B, 3:
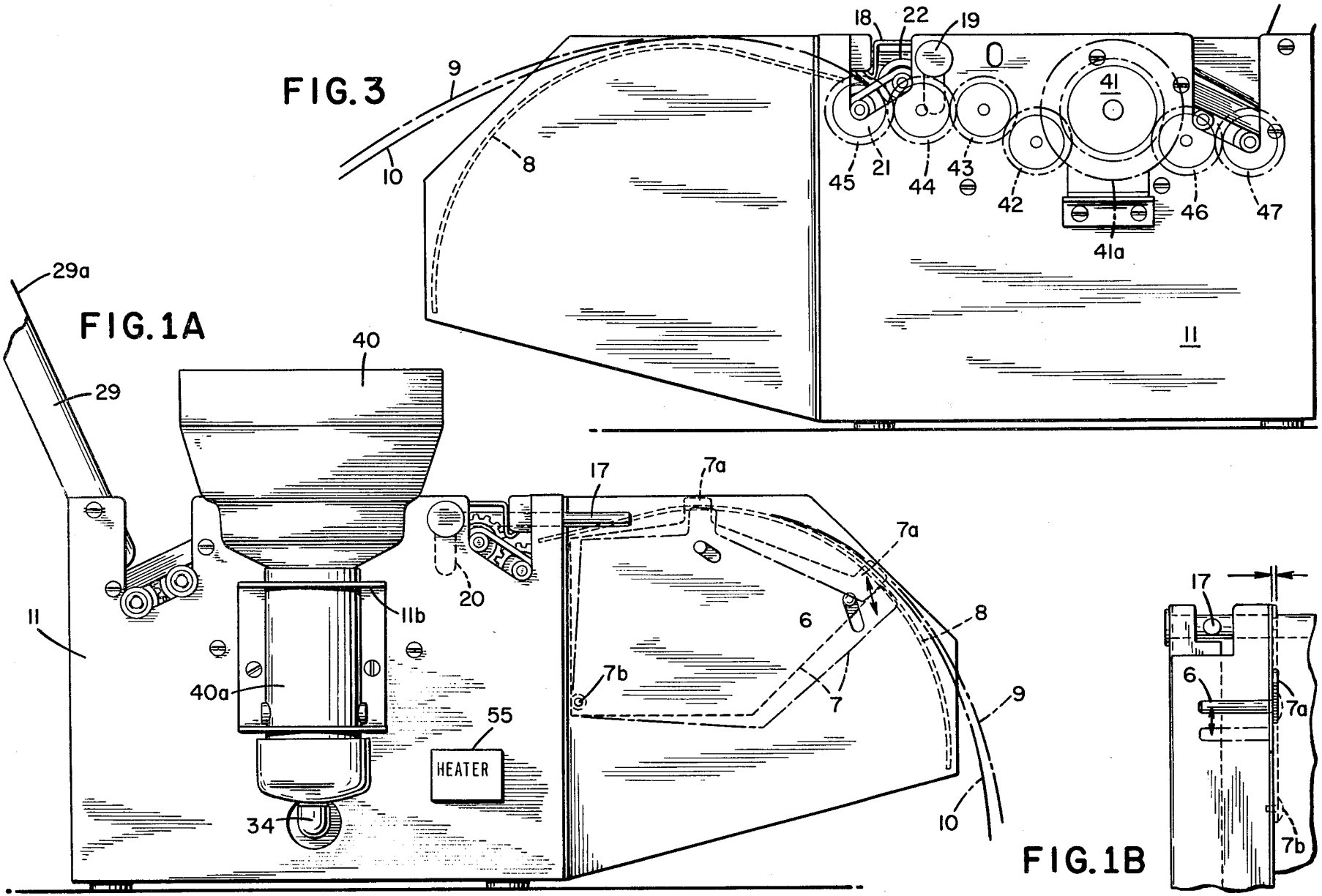
FIG. 1A is a side view of a D.T. processor in accordance with a preferred embodiment of the invention.
FIG. 1B illustrates the margin index of the film and paper support station.
FIG. 3 illustrates an opposite side view of the processor of the present invention.
Figure 2:
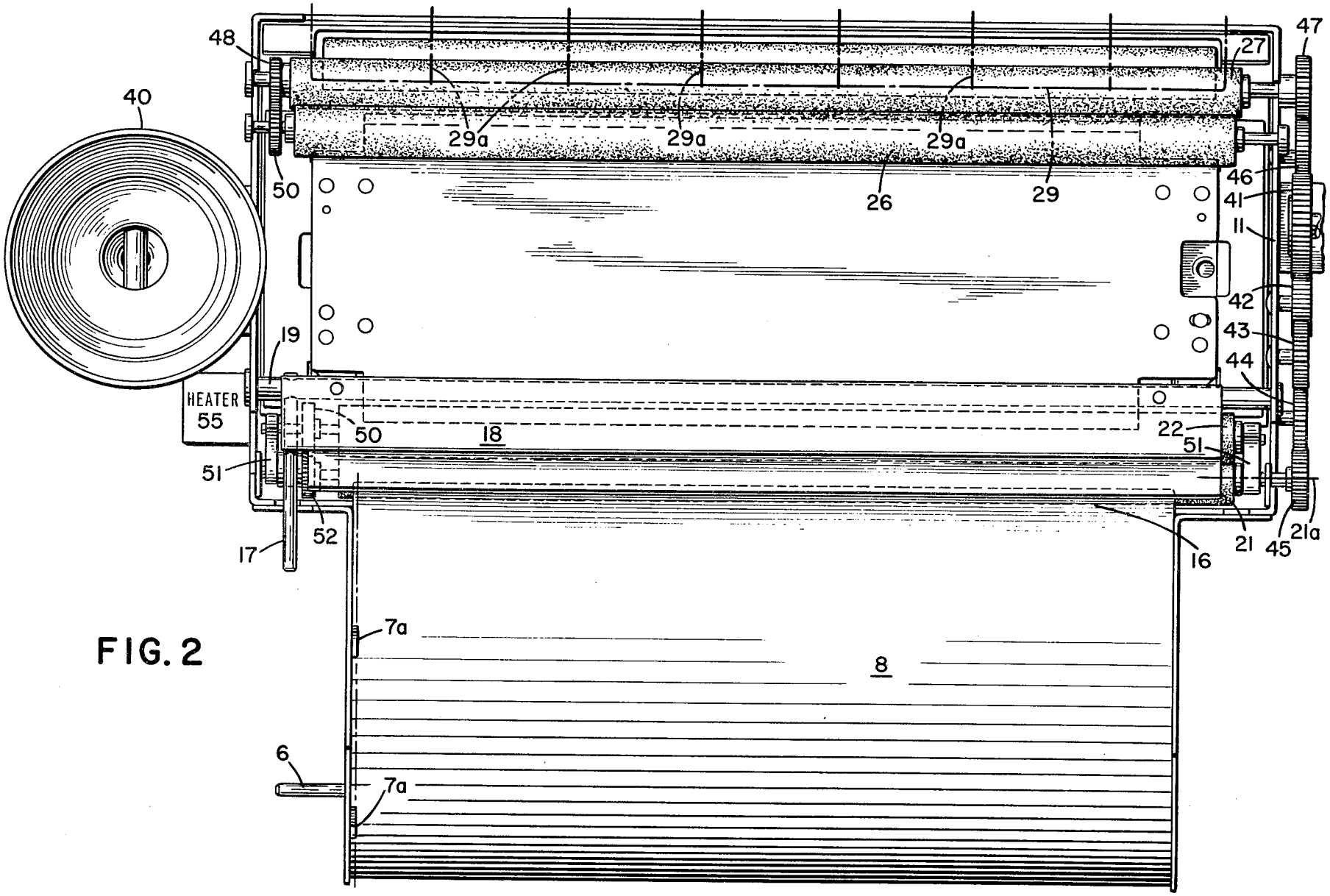
FIG. 2 is a top view of the processor of FIG. 1.

Referring now to FIGS. 1A and 2, there is shown, respectively, a side view and a top view of a diffusion transfer processor in accordance with the preferred embodiment. Shown in the views are a print medium 9 and an exposed but unprocessed reversal positive photographic film 10. The print medium 9 and exposed film 10 are inserted in the processor in accordance with the following sequence.

A loading station 8 comprises a front portion, generally curved to reduce the amount of flexing stress experienced by a large sheet of film material as it is being fed into the processor. Prior to advancing the exposed film material 10 into the processor, the leftward margin is set by operating handle 6, which raises margin indexes 7*a* from their lowermost postion through corresponding apertures in the curved surface of station 8, to protrude above the surface of loading station 8, thus providing a leftward margin. FIG. 1B is illustrative of the handle 6 arrangement with respect to the margin indexes 7*a*. The margin index plate 7 is pivoted at 7*b* to the loading station 8 to enable it to elevate indexes 7*a* in response to the movement of handle 6.

The photographic film sheet 10 is advanced between rollers 21 and 22 (FIG. 4A) by activating a motor 41 connected to drive the rollers in a sheet advancing direction. Motor 41A is first activated for only a limited predetermined time in order to advance the sheet of exposed film material 10 into the film processor by a distance sufficient to compensate for the longer path traversed by sheet 10 compared to receiving sheet 9, and to provide non-imaged borders at the top and bottom of the resulting print on sheet 9, said time being related to the desired advance distance for sheet 10.

Having inserted film material 10 into the processor, image-receiving medium 9 is thereafter inserted. In this instance, because the margin indexes 7*a* are not raised, the print medium is registered against the leftward side of station 8, providing an imageless border along the sides of the final print. The emulsion of print medium 9, which may be conventional photographic paper, is placed in contact with the photographic emulsion surface 10 and is fed into the nip of feed rollers 21 and 22.

Prior to initiating the second operation of motor 41, which will advance both the print medium 9 and the photographic film 10 into the processor, handle 17 is raised to change the angle of feed for feed rollers 21 and 22. By raising handle 17, roller 22 is rotated about the axis of roller 21, thereby rotating the location of the nip provided by the feed rollers with respect to the processor. The change in feed angle resulting from rotating feed rollers 21 and 22 provides a path for the print medium 9 to follow which is separate, distinct and shorter than the path followed by film 10.

Figure 8:
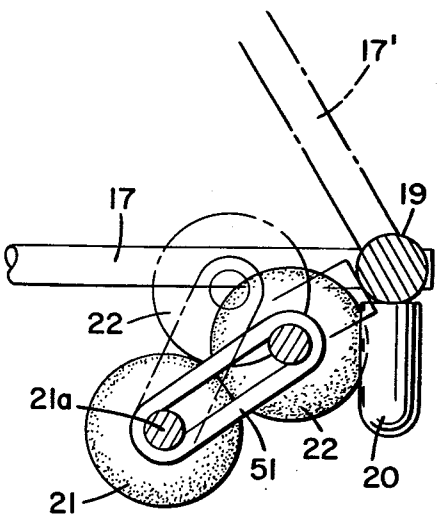
FIG. 8 is an opposite end view of the rollers 21, 22 during a feed direction change.
Figure 7:
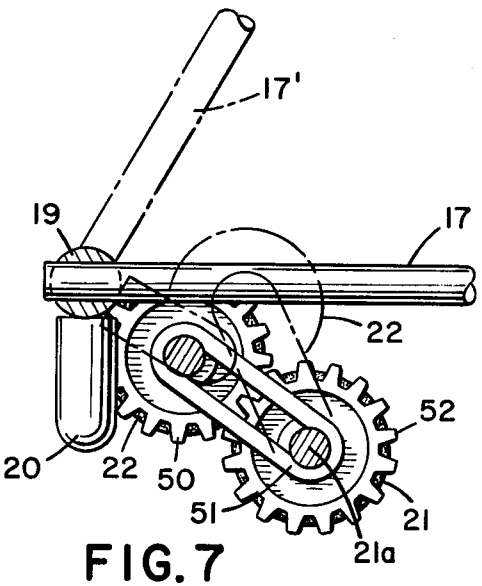
FIG. 7 is a more detailed view of one end of the feed rollers 21, 22 during a change in feed directions.

Referring to FIGS. 7 and 8, end views of the feed rollers 21, 22 are seen illustrating the change in feed direction obtained by operating handle 17. In position 17', roller 22 is displaced about the rotational axis 21*a* of roller 21 to change the direction of feed of rollers 21, 22. Clamp members 51 maintain rollers 21 and 22 in tangential relationship during rotation.

Referring now to FIG. 3, the drive for feed rollers 21 and 22 is provided by a gear 45 directly connected to the rotational shaft of roller 21. At the opposite end of roller 21 is another gear 52 (FIG. 2) which meshes with a gear 50 for rotating roller 22. Thus, it is seen that the rollers do rotate together and, upon rotation of handle 17, the feed roller 22 rotates about the axis of feed roller 21 for changing the angle of discharge of feed rollers 21 and 22. Idler gears 44, 43 and 42 are provided in order to operatively couple motor drive gear 41 to the feed rollers 21 and 22.

Also shown, particularly with respect to FIG. 2, are an additional pair of rollers 26 and 27, which are the laminating rollers of the device. As the sheets of print medium 9 and photographic film emulsion 10 exit their respective first and second paths, they are laminated together by passage between lamination rollers 26, 27. The exiting laminated materials are then pushed upward along a generally vertically-extending receiving tray 29.

Additionally shown is an activator container 40 for storing the fluid used in processing the emulsion on exposed film 10 prior to the laminating step.

Figures 4A, 4B:
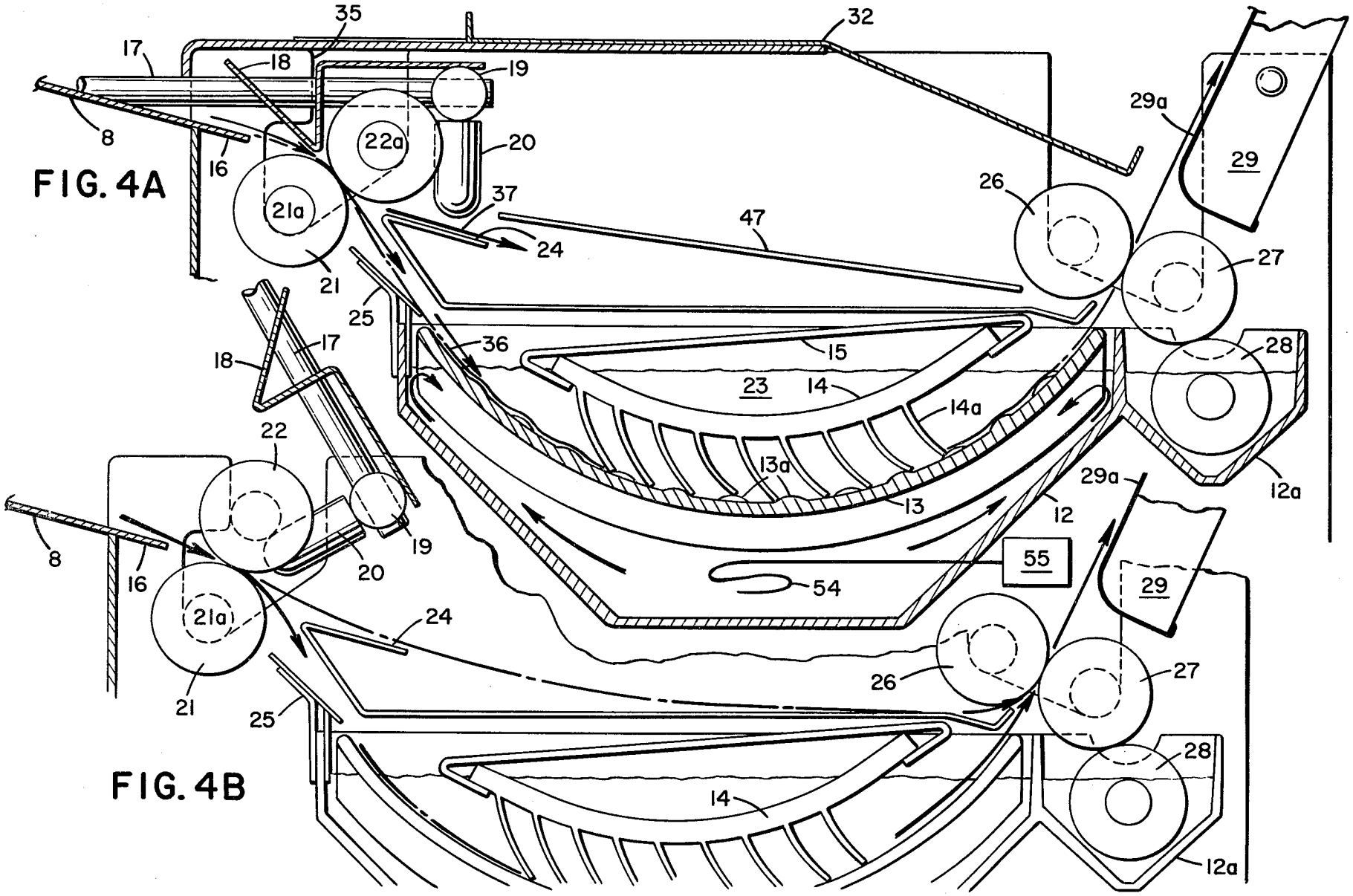
FIGS. 4A and 4B are sectional views of the processor of the preferred embodiment.

Having thus described, with respect to the top and side views of the preferred embodiment, the overall operation of the D.T. processor, reference will now be made to FIG. 4A, illustrating a sectional view of a preferred embodiment. There is shown a first front edge guide 16 which is an extension of the top portion of the loading station 8 for guiding the print medium 9 and exposed film 10 into the processor. An upper entrance guide 18, disposed above the front edge guide 16 formed from an extension of loading station 8, has a front guide portion lying in a plane converging with the plane of the lower front edge guide 16, at the approximate nip of the feed roller pair 21 and 22. This position of the upper entrance guide 18 can be rotated by handle 17 upon the feeding of the print medium 9 as previously described. Referring to FIG. 4B, the rotation of handle 17 is shown to rotate shaft 19 and feed control arm 20 against the shaft of upper feed roller 22. Upper feed roller 22 will thereby rotate about the axis 21*a* of lower feed roller 21, thus changing the direction of feed of the feed roller pair 21 and 22.

Returning now to FIG. 4A, two distinct feed paths 36 and 37 can be seen, which are selected by the position of the feed rollers 21 and 22. Upon the initial feeding of the exposed sheet 10 through feed rollers 21 and 22, path 36 will be selected for processing the image contained on the sheet. The path 36 begins between lower deflector guide 25 and upper deflector guide 24. These guides, 24 and 25, exit into activator fluid 23. The activator solution 23 is maintained in a reservoir tank 12, which receives replenishment through container 40 and conduit 34 of FIGS. 1 and 5. At one end of the solution tank 12 is a standard heating element 54 connected to an adjustable thermostatic control 55 for establishing a constant, uniform temperature for fluid 23.

Figure 12:
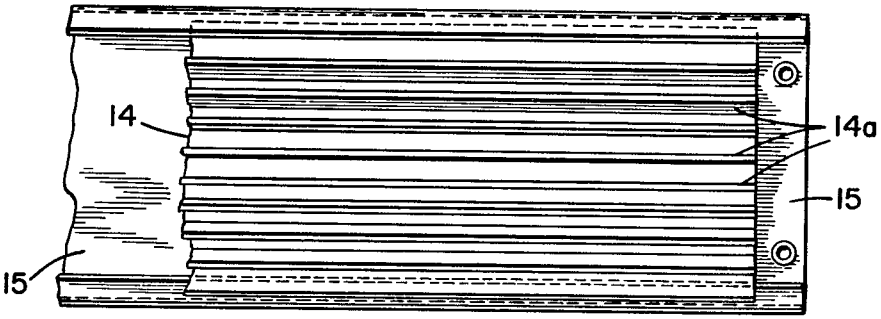
FIG. 12 is a bottom view of squeegee 14 maintained in bracket 15 before insertion in tray 12.
Figure 11:
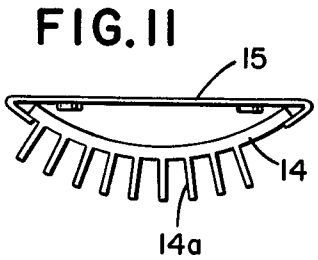
FIG. 11 illustrates squeegee 14 maintained in an arcuate shape by bracket 15.
Figure 10:
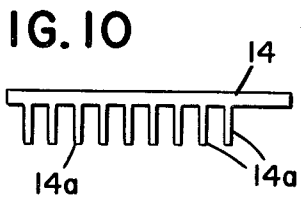
FIG. 10 is a side view of squeegee 14*a*.

Induction of chemistry for use in developing the image on film sheet 10 begins as the sheet enters activator fluid 23. A lower guide 13 containing a plurality of dimples or protrusions 13*a* is provided to guide the film through the solution until it exits in the plane of the nip of laminating rollers 26 and 27. The protrusions minimize the surface tension between film sheet 10 being processed and guide 13. This lower wet processing path 36 also contains a squeegee assembly 14, shown in both the assembled and unassembled condition with bracket 15 in FIGS. 10, 11 and 12, having a plurality of soft, flexible vanes 14*a* supported in an arcuate shape by means of bracket 15, which touches the surface of lower guide 13. In practice, a squeegee having a hardness durometer rating of 20 has been found suitable.

Figure 9:
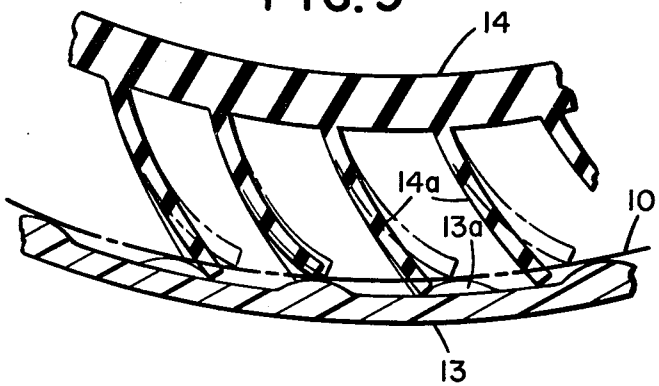
FIG. 9 illustrates the agitation of the activator fluid by protrusions 13*a* and squeegee assembly 14.

The action of the lower guide 13 and squeegee 14, shown more particularly in FIG. 9, is such that the passage of film sheet 10 between the flexible blades 14*a* and the protrusions 13*a* results in local agitation of solution 23, thereby maintaining the chemical activity and uniformity of solution 23 at the emulsion surface of sheet 10 being developed. The motion of flexible squeegee vanes 14*a* over protrusions 13*a* resulting from passage of the leading and trailing edges of sheet 10 enhances the temperature uniformity of the solution 23 as a result of fluid mixing and contributes to uniform development of the film image.

The second feed path 37 is defined by the upper edge of upper deflector guide 24 and an additional guide 47. The image-receiving medium 9 passes between guides 47 and 24, exiting the path 37 in a plane coincident with the exit trajectory of the lower wet path 36. Laminating rollers 26 and 27 provide a pressing contact between image-receiving medium 9 and exposed film 10 as they enter the rollers' nip.

Laminating rollers 26 and 27, as can be seen by referring to FIG. 2, are geared together through gears 48 and 50. Gear 47 operatively drives the laminating roller 27 from an idler gear 46 coupled to main drive gear 41. Also associated with laminating rollers 26 and 27 is a moistening roller 28, supported for rotation within a moistening chamber 12*a* which is integral with solution tank 12. An opening between solution tank 12 and moistening chamber 12*a* permits the same level of activating solution 23 to be maintained on the lower surface of moistening roller 28. Upon rotation of laminating roller 27, moistening roller 28 in contact therewith will maintain the surface laminating rollers 26, 27 uniformly wet with activating solution, thereby avoiding any change in the distribution of fluid on the laminating roller surfaces which would otherwise degrade the print then being formed by the diffusion transfer process. The cover 32 of the film processor, not shown heretofore, includes an opening for permitting the laminated combination of film medium and print paper to exit. Receiving tray 29, disposed in a generally vertical direction downstream from the nip of rollers 26, 27, includes a plurality of vertical monofilament ribs 29*a*, which break the surface tension between the receiving tray 29 and the underside of the laminated film structure received from rollers 26, 27.

As is well known with respect to the process of diffusion transfer printing, the laminated print medium and film remain in the receiving tray 29 for the required time before being manually separated, at which time film sheet 10 is discarded and the image is seen on print medium 9.

Figures 5, 6A, 6B:
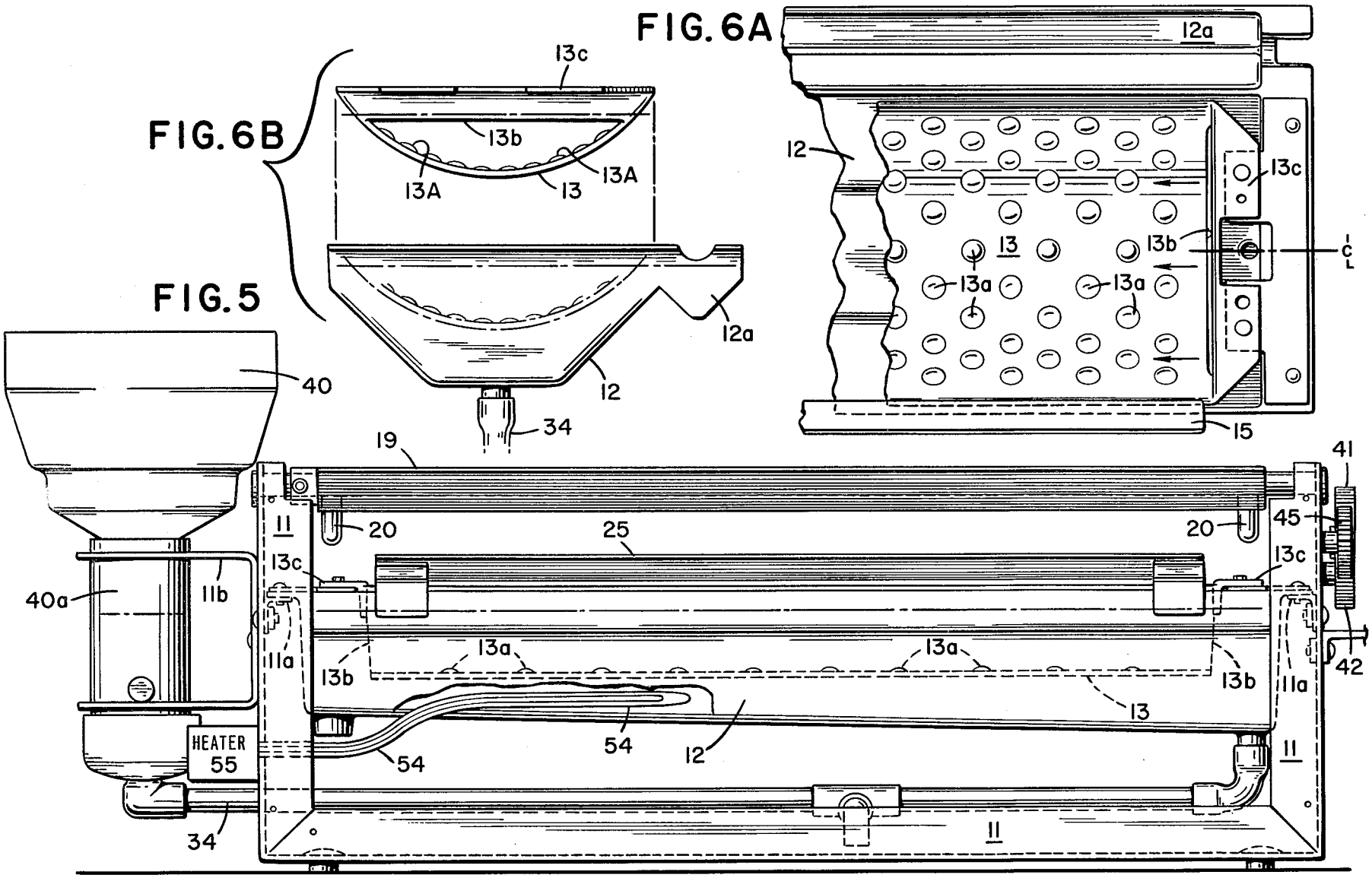
FIG. 5 is an end section view of the processor of the preferred embodiment.
FIG. 6A is a top view of the bottom guide 13 of the wet path provided by the processor.
FIG. 6B is a side view of the bottom guide 13 of the wet path 36.

The processor of the preferred embodiment is further shown in sectional view in FIGS. 5, 6A and 6B. FIG. 5 illustrates the container 40 connected by its neck 40*a* through a bracket 11*b* secured on chassis 11. Conduit 34 supplies the activating solution to solution tank 12. Solution tank 12 is mounted rigidly, by means of bracket 11*a*, to the overall chassis 11, the rollers (both feed and laminating 21, 22, 26 and 27) being omitted from FIG. 5. A further section view of FIG. 5 is shown in FIG. 6B, which identifies more clearly the dimpled lower guide 13 with its fluid opening 13*b* along the lateral edge thereof, which permits solution 23 to circulate from the solution tank 12. Lower guide 13 is held by flange members 13*c* on the edges of solution tank 12. The circulation of activator solution 23 occurs as a result of convection induced by the heating element 54, thermostatically controlled by control 55. By restricting the fluid flow primarily to the ends of the dimpled lower guide, the temperature profile along the surface of the guide is maintained substantially constant. Thus, thermal currents and local hot spots, such as are found in prior art systems having an apertured lower guide surface, are minimized.

FIG. 5 illustrates that the processor chassis 11 is substantially of sheet metal construction, having end supports for feed control rod 19 and for the plurality of gears 41, 42 and 45. Also, as shown more particularly in FIGS. 2, 3 and 1A, cutouts for supporting the feed rollers and laminating rollers 21, 22 and 26, 27 are provided, and a cover 32 is easily secured over the top of the processor, as shown in FIG. 4A.

Thus, there is shown and described a diffusion transfer processor which provides a minimum of thermal and pressure disturbances to an image-carrying medium being transported through an activating solution 23. The aforesaid D.T. processor is capable of avoiding these temperature and pressure disturbances in color film printing wherein sensitive reversal positive film is to be developed. The well-known Kodak EKTAFLEX TM positive reversal film can be processed in the processor, using the KODAK TM activator commonly recommended for developing the film and effecting the image transfer.

The motor drive gear 41 has only been briefly described. The motor 41A connected to drive gear 41 also includes a motor control unit which is operative in response to a footswitch for advancing the film medium 10 by a predetermined distance through path 36. A second switch is used to continuously enable motor 41 to provide rotation of feed rollers 21 and 22 at a rate such that, after insertion of the print medium 9, the combined film and print medium have a process time of about 20 seconds in the activating fluid, corresponding to the preferred activator soak time recommended by the manufacturer of the chemistry.

One embodiment of a processor of the diffusion transfer type, capable of developing reversal positive film and of transferring the resulting image, in full color, to a receiving sheet, has been described.

Those skilled in the art will recognize further embodiments, as described by the following claims.

What is claimed is:

1. A diffusion transfer processor comprising:

a pair of feed rollers for receiving a print medium and an exposed image-bearing photographic sheet for printing on said medium, said rollers positionable to feed said photographic sheet and said print medium initially in different directions;

a first developing path having an entrance facing said rollers and in a direction to receive said photographic sheet, and an exit; said path extending through a container of activating solution and having a solid bottom arcuate guide portion provided with a plurality of raised protrusions, and a plurality of flexible vane members supported in contact with said protrusions and deflectable upon passage of said film sheet along said bottom guide portion, deflection of said vane members providing local agitation of said developer solution;

a print medium path including an entrance facing said rollers and in a direction for receiving said print medium, and an exit coplanar with an exit of said first developing path;

a pair of laminating rollers disposed at said exits for receiving said print medium and said photographic film sheet concurrently, said laminating rollers pressing said film sheet and print medium together as they exit said paths; and a moistening roller supported for rotation in a moistening fluid chamber and in contact with one of said laminating rollers for moistening said laminating rollers.

2. The apparatus of claim 1 wherein said arcuate bottom guide portion is impervious.

3. The apparatus of claim 1 further comprising a heater for warming said solution.

4. A diffusion transfer processor comprising:

means for feeding a photographic film sheet and a print medium into first and second separate paths, said paths having coinciding exit apertures lying in a common plane;

said first path including a developing tray for maintaining a supply of activator fluid;

a heater to maintain said fluid at a predetermined temperature;

a lower arcuate guide member including a plurality of spaced protrusions and supported in said tray, with a front edge of said guide terminating at the input end of said first path and an opposite edge of said guide terminating at an exit end of said path;

a plurality of flexible blades supported to contact said guide member protrusions, whereby a photographic film sheet is received from said means for feeding and conveyed between said flexible blades and said lower arcuate guide by deflecting said blades, locally agitating and homogenizing said fluid as said sheet passes to said path exit; and means for pressing said developed film sheet exiting said first path against a print medium exiting said second path, whereby the diffusion transfer of the image from said film sheet to said print medium takes place.

5. The diffusion transfer processor of claim 4 wherein said means for pressing said developed film sheet to said print medium comprises:

a pair of rollers tangent along a line within the plane of said film sheet and print medium; and a moistening roller in contact with said pair of rollers and extending into a fluid chamber integral with said developing tray, said fluid chamber having an inlet communicating with the interior of said developing tray whereby said rollers remain uniformly wet with said activating fluid.

6. A diffusion transfer processor comprising:

a housing open at one end to receive a photographic film sheet and print medium, and open at an opposite end to deliver a developed photographic sheet in intimate contact with said print medium;

a first pair of feed rollers supported for driven rotation in said first opening, one of said rollers being rotatable about the other of said rollers whereby first and second directions of feed are realized;

a baffle supported in said housing between said open ends and separating a first dry path for receiving said print medium fed along said second direction from a wet developing path;

a developing tank attached to said housing below said baffle for holding developing solution;

an arcuate guide member supported in said developing tank, below said baffle, said guide member extending between said housing openings and having a front edge positioned to receive a photographic sheet fed along said first direction, said guide member including a plurality of protrusions for reducing surface tension between said photographic sheet and said arcuate guide member;

a plurality of flexible vane members supported for contacting said protrusions, or the emulsion of said photographic sheet, said vane members being displaced upon movement of said photographic sheet along said guide member to locally agitate said activating solution adjacent the emulsion of said film sheet;

a second pair of rollers supported for rotation at said opposite end of said housing, said rollers contacting each other along a line positioned to receive both said print medium and said photographic sheet, whereby said print medium and said photographic sheet are pressed firmly together; and a support member including a plurality of narrow vertical ribs, said support being connected to said housing at said opposite end and extending substantially vertically for receiving said pressed-together print medium and photographic film sheet.

7. The diffusion transfer processor of claim 6 further comprising:

a bar member supported for rotation parallel to said pair of feed rollers;

first and second perpendicularly-extending pin members connected to said bar member, said members contacting said one roller upon rotation of said bar member whereby said one roller rotates with respect to the remaining roller; and a lever connected to said bar member for rotating said bar member and pin members, whereby said feed rollers change the material-feeding direction between said dry and wet paths.

8. The diffusion transfer processor of claim 7 further comprising:

a wetting roller having a surface in contact with one of said second pair of rollers, supported for rotation in a wetting chamber integral with said activating solution developing tank and connected to receive activating solution from said solution developing tank, whereby activating fluid from said tank moistens the surface of said second pair of rollers.

9. The diffusion transfer processor of claim 7 further comprising:

a material support surface connected to said housing adjacent said one end, said support providing an adjustable edge margin for positioning material laterally with respect to said feed rollers.

* * * * *